US010688540B2

(12) United States Patent
Bode et al.

(10) Patent No.: US 10,688,540 B2
(45) Date of Patent: Jun. 23, 2020

(54) ADVANCING UNIT FOR A PIPE CLEANING MACHINE, PIPE CLEANING MACHINE, AND ASSOCIATED METHOD

(71) Applicant: Rothenberger AG, Kelkheim (DE)

(72) Inventors: Olaf Bode, Selters (DE); Maximilian Gottschalk, Eltville (DE)

(73) Assignee: Rothenberger AG, Kelkheim (DE)

( * ) Notice: Subject to any disclaimer, the term of this patent is extended or adjusted under 35 U.S.C. 154(b) by 212 days.

(21) Appl. No.: 15/555,789

(22) PCT Filed: Feb. 29, 2016

(86) PCT No.: PCT/DE2016/100089
§ 371 (c)(1),
(2) Date: Sep. 5, 2017

(87) PCT Pub. No.: WO2016/141923
PCT Pub. Date: Sep. 15, 2016

(65) Prior Publication Data

US 2018/0036777 A1 Feb. 8, 2018

(30) Foreign Application Priority Data

Mar. 6, 2015 (DE) ..... 10 2015 103 349

(51) Int. Cl.
*B08B 9/045* (2006.01)
*E03F 9/00* (2006.01)

(52) U.S. Cl.
CPC ..... *B08B 9/045* (2013.01); *E03F 9/005* (2013.01)

(58) Field of Classification Search
CPC ..... B08B 9/045; E03F 9/005
See application file for complete search history.

(56) References Cited

U.S. PATENT DOCUMENTS 3,882,565 A 5/1975 Irwin et al.
5,031,276 A 7/1991 Babb et al.
(Continued)

FOREIGN PATENT DOCUMENTS

EP 0 443 290 A2 8/1991
EP 0 894 906 A2 2/1999
(Continued)

OTHER PUBLICATIONS

Written Opinion of the International Searching Authority of PCT/DE2016/100089, dated Aug. 19, 2016.
(Continued)

*Primary Examiner* — Andrew A Horton
(74) *Attorney, Agent, or Firm* — Smartpat PLC

(57) ABSTRACT

An advancing unit for a cleaning spiral, which can be rotated by a motor about its longitudinal axis, of a pipe cleaning machine, such as, for example, a pipe cleaning machine having a drum. The advancing unit includes a drive device, which produces the advancement of the cleaning spiral, with at least two clamping parts, wherein at least one clamping part thereof can be brought into a clamping position against the cleaning spiral in such a manner that the clamping parts press against the cleaning spiral, so that an advancement of the cleaning spiral is generated in the case of a rotating cleaning spiral. The advancing unit further comprises a control device for controlling the advancement of the cleaning spiral by means of at least one of the clamping parts as well as a safety device, by which at least one of the clamping parts can be brought out of its clamping position against the cleaning spiral. It is provided that the control device and the drive device and/or the safety device can be actuated by means of a common handle part. The invention further relates to a pipe cleaning machine, in particular a pipe
(Continued)

Figure 1:
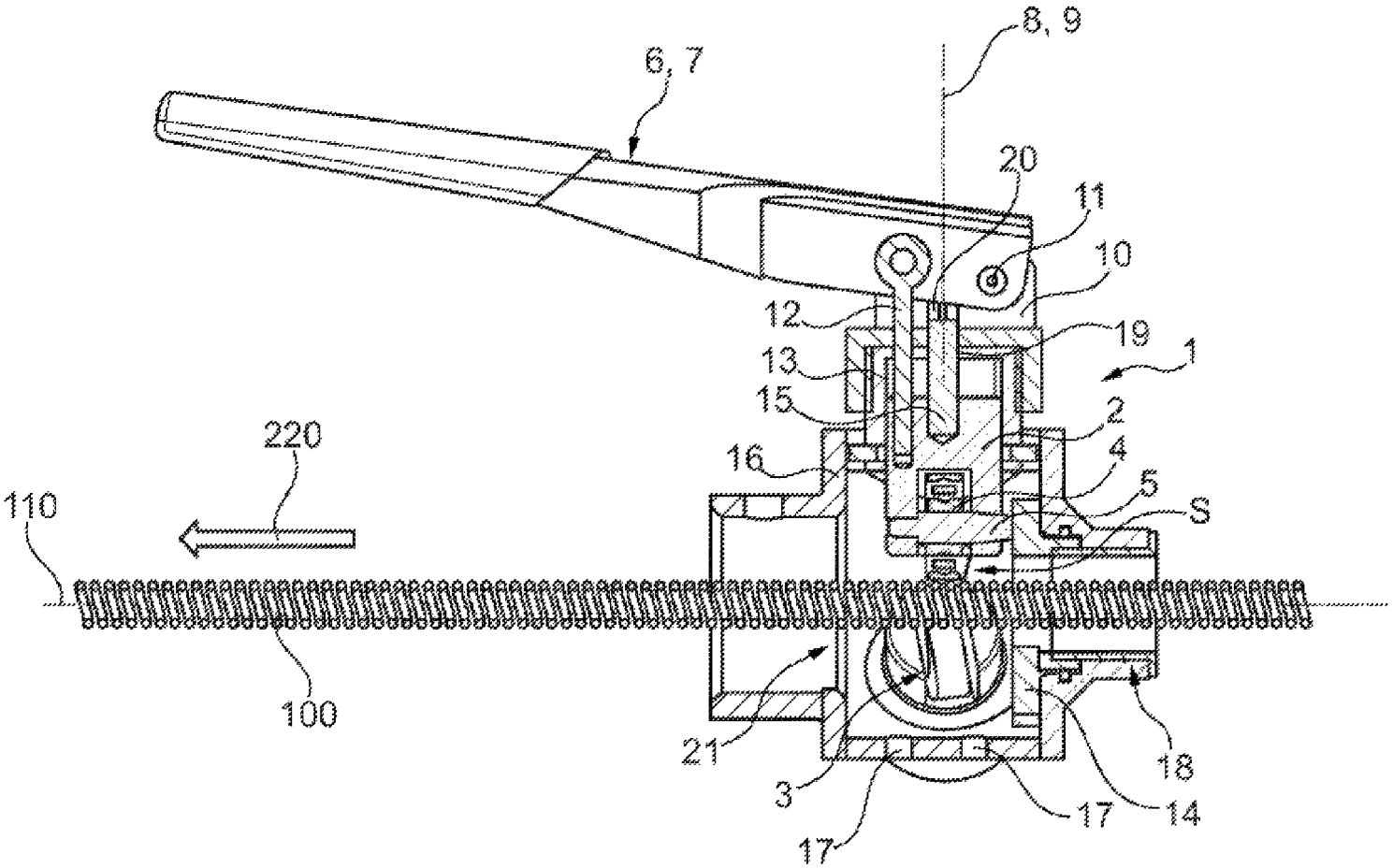

cleaning machine having a drum, and to a method for operating a pipe cleaning machine.

15 Claims, 3 Drawing Sheets

(56) References Cited

U.S. PATENT DOCUMENTS

| | | | | |
|---|---|---|---|---|
| 5,640,736 | A * | 6/1997 | Salecker | B08B 9/045 15/104.31 |
| 5,901,401 | A | 5/1999 | Rutkowski et al. | |
| 6,360,397 | B1 | 3/2002 | Babb | |
| 2005/0246846 | A1 * | 11/2005 | Rutkowski | B08B 9/045 15/104.33 |

FOREIGN PATENT DOCUMENTS

| | | | | |
|---|---|---|---|---|
| EP | 0894906 | A2 * | 2/1999 | B08B 9/045 |
| EP | 156 167 | A2 | 11/2001 | |
| NL | 9100342 | A | 9/1992 | |

OTHER PUBLICATIONS

International Search Report of PCT/DE2016/100089 dated Aug. 19, 2016.

* cited by examiner

ADVANCING UNIT FOR A PIPE CLEANING MACHINE, PIPE CLEANING MACHINE, AND ASSOCIATED METHOD

CROSS REFERENCE TO RELATED APPLICATIONS

This application is the National Stage of PCT/DE2016/100089 filed on Feb. 29, 2016, which claims priority under 35 U.S.C. § 119 of German Application No. 10 2015 103 349.6 filed on Mar. 6, 2015, the disclosures of which are incorporated by reference. The international application under PCT article 21(2) was not published in English.

The invention relates to an advancing unit for a pipe cleaning machine, particularly to a pipe cleaning machine having a drum. The invention furthermore relates to a pipe cleaning machine.

Pipe cleaning machines serve for cleaning of pipelines, such as, for example, drain pipes. For this purpose, the cleaning spiral is put into rotation, if applicable with a cleaning tool that is mounted on the end side, and introduced into the pipeline to be cleaned. The rotational movement of the cleaning spiral is usually generated by means of a motor, for example by means of an electric motor. In the case of pipe cleaning machines having a drum, the rotational movement of the cleaning spiral is generated by means of a torque-proof connection between the cleaning spiral and a drum driven so as to rotate, on which drum the cleaning spiral is kept on hand, wound up on it.

The pipe cleaning machines usually have an advancing unit by means of which a drive of the cleaning spindle can be generated and adjusted. For this purpose, clamping parts are usually used, which parts are pressed against the rotating cleaning spiral, and thereby a drive is generated. Furthermore, the drive can be controlled by means of a change in position of the clamping parts in the pressed-down position against the rotating cleaning spiral.

Furthermore, the advancing device is usually provided with a safety device. A torsion stress that suddenly occurs in the cleaning spiral is relieved by means of the safety device, or already prevented right from the start, and thereby a hazard situation for the operator of the pipe cleaning machine is prevented. Such sudden torsion stresses occur, for example, if the head of the cleaning spiral encounters a blockage to be cleaned and is braked severely, and the cleaning spiral itself continues to be driven so as to rotate.

It has been shown in practice that an operator needs one hand to guide the cleaning spiral during pipe cleaning. As a result, the operator only has one hand that remains free for operating the pipe cleaning machine. This frequently makes operation of the pipe cleaning machine difficult for the operator.

An embodiment of the invention is therefore based on the task of proposing at least one possibility by means of which simple operation and handling of a pipe cleaning machine is made possible.

This task is accomplished with an advancing unit that has the characteristics of claim 1. Furthermore, this task is accomplished with a pipe cleaning machine that has the characteristics of claim 12. Furthermore, in order to accomplish the task, a method for operation of a pipe cleaning machine, having the characteristics of claim 13, is proposed. Advantageous embodiments of the invention are evident from the dependent claims and from the following description and the figures.

According to an embodiment of the invention, an advancing unit is provided for a cleaning spiral of a pipe cleaning machine, for example of a pipe cleaning machine having a drum, which cleaning spiral can rotate about its longitudinal axis by means of a motor. The cleaning spiral is understood to be a spiraled, flexible shaft, which is also referred to as a cleaning snake or spring shaft.

The advancing unit has a drive device that can produce a drive of the cleaning spiral, with at least two clamping parts, of which at least one clamping part can be brought into a clamping position against the cleaning spiral, in such a manner that the clamping parts press against the cleaning spiral, so that when the cleaning spiral rotates, a drive of the cleaning spiral is produced. The advancing unit furthermore has a control device for controlling the drive of the cleaning spiral, for example the drive direction and/or the drive speed, by means of at least one of the clamping parts. Furthermore, the advancing unit has a safety device by means of which at least one of the clamping parts can be brought out of its clamping position against the cleaning spiral. In this way, the force fit that is produced by the clamping parts, relative to the cleaning spiral, for producing the advancing movement is cancelled out.

It is provided that the control device and the drive device and/or the safety device can be activated by means of a common handle part.

By means of this measure, the advancing unit and thus a pipe cleaning machine having such an advancing unit can be operated in simple manner. For this purpose, an operator merely needs a single free hand for operating the advancing unit. By means of such single-handed operation, the operator has the other hand free to guide the cleaning spiral, for example, and/or to form a working arc from a length section of the cleaning spiral and thereby to exert pressure on a section of the cleaning spiral that is already situated in the pipeline.

In that the handle part is coupled with the drive device, the at least one clamping part can be brought into the clamping position on the cleaning spiral by means of the handle part, and thereby the drive of the rotating cleaning spiral can be produced. In that alternatively or supplementally, the handle part is coupled with the safety device, the safety device can be triggered or activated by means of the handle part, for example in that the clamping parts or at least one of the clamping parts is/are brought out of the clamping position against the cleaning spiral. Furthermore, the drive of a rotating cleaning spiral can be controlled by means of the handle part, in that the control device is activated by means of the handle part, and thereby a forward drive or reverse drive, for example, of the rotating cleaning spiral is adjusted. Fundamentally, all the functions of the advancing unit can be performed by means of operation of the handle part.

According to an embodiment of the invention, it is provided that the handle part is mounted so as to rotate about an axle, and is mounted so that it can be displaced or pivoted in the direction of the axle, wherein at least one of these types of movements is used for activation of the drive device and/or for triggering of the safety device, and another one of these types of movements is used for activation of the control device. In this way, the common handle part can be implemented in technically simple manner, in order to be able to activate the control device and the drive device and/or the safety device with it.

In particular, it can be provided that for pivoting in the direction of the axle, the handle part can be pivoted about a pivot axle, which lies at a distance from the axle. In this way, an advantageous lever ratio with regard to performing a rotational movement of the handle part about the axle occurs facilitated, particularly if the handle part extends transversely to the axle with its longitudinal expanse during the rotational movement.

In technically simple manner, activation of the advancing unit is achieved if, according to a further embodiment of the invention, the drive device and the safety device can act or do act on at least one common clamping part, particularly can act or do act on the at least one clamping part that can be brought into the clamping position against the cleaning spiral.

The measure of a further embodiment of the invention, according to which the drive device and/or the safety device, together with the control device, can act or do act on at least one common clamping part, particularly can act or do act on the at least one clamping part that can be brought into the clamping position against the cleaning spiral, aims in the same direction.

The drive device and the safety device can utilize a common mechanism so as to be able to produce the force fit between the clamping parts and the rotating cleaning spiral, and also so as to be able to cancel out the force fit again.

For example, according to a further embodiment of the invention, it is provided that the handle part is configured as an activation lever, which is mounted so as to pivot about a pivot axle, on a control part, in the direction of a or the setting axis for one of the clamping parts. Preferably, a transfer element that acts on the one clamping part in the direction of the setting axis engages on the activation lever, particularly at a distance from the pivot axle on the activation lever. The clamping part is displaced along the setting axis, for example, in order to achieve the clamping position against the cleaning spiral. In particular, the setting axis is disposed radially with reference to the cleaning spiral.

In this way, a pivoting movement and a rotational movement of the handle part, configured as an activation lever, are utilized to operate the advancing unit. In this regard, the physical requirements for activation of the drive device and of the control device are taken into account, in that for controlling the drive, the handle part and thereby the clamping part are rotated, and for producing the clamping effect of the cleaning spiral between the clamping parts, the activation lever must perform a pivoting movement. By means of the pivoting movement, the force of the lever arm of the activation lever is utilized, in order to exert the greatest possible pressure force on the cleaning spiral by way of the transfer element and the one clamping part. For this purpose, the transfer element should be configured so as to be stable in shape, particularly to be rigid. For example, the transfer element is formed by an eyebolt, the eye of which is mounted on the activation lever so as to rotate.

In particular, an advantageous lever ratio occurs for exerting the pivot movement of the activation lever, and thereby an improved transfer of force from the activation lever to the one clamping element occurs if the transfer element engages on the activation lever at a distance from the pivot axle and the activation lever extends transversely to the setting axis for the one clamping element with its longitudinal expanse, for example. In particular, an advantageous lever ratio occurs for exerting the rotational movement of the activation element about the setting axis, and thereby an improved transfer of force from the activation lever to the one clamping element occurs if the transfer element engages on the activation lever at a distance from the pivot axle, and the setting axis lies between the pivot axle and the engagement location of the transfer element on the activation lever.

It can be provided that the control part is mounted, so as to rotate, on a guide part that is fixed in place on the housing and guides the one clamping part in the case of a movement in the direction of the setting axis and/or in the case of a rotational movement about the setting axis. Operationally reliable and lasting operation or activation of the handle part is guaranteed by means of the guide part.

For example, the guide part is configured as a sleeve element or tube element, on the outside circumference of which the control part is mounted so as to rotate, and on the inside circumference the clamping part is guided. For example, the guide part has a thread on its outside circumference, which thread interacts with a counter-thread of the control part, in order to form the rotatable mounting of the control part relative to the guide part. In this manner, rotatable mounting of the control part on the guide part is implemented in technically simple manner.

In particular, it can be provided that the activation lever, the control part, the transfer element, and the one clamping part are connected in torque-proof manner with regard to the setting axis, and can be rotated about the setting axis relative to the guide part. As a result, the transfer element serves to transfer the rotational movement of the activation element to the one clamping part about the setting axis.

In particular, it can be provided that the transfer element and the one clamping part are connected in displacement-proof manner with regard to the setting axis, and can be displaced in the direction of the setting axis relative to the control part and the guide part. In this way, a transfer of force to the one clamping part is implemented in simple manner for the case that the activation lever performs a pivot movement.

Furthermore, an additional guide part can be provided, which part is firmly connected with the one clamping part and is guided on a wall of an opening of the guide part that is fixed in place on the housing and/or on a wall of an opening of the control part.

The mechanism described above can act only on the one of the clamping parts, by means of which the clamping part can be displaced in the direction of the setting axis and rotated about the setting axis. It can also be the case that the mechanism acts on multiple ones of the clamping parts, particularly on all the clamping parts. For example, the mechanism acts only on the one clamping part, in order to bring about a setting movement, in that the one clamping part is displaced in the direction of the setting axis. However, if a control movement is performed, in which the one clamping part is rotated about the setting axis, it can happen, due to the coupling of the clamping parts with one another, for example by way of a common driver, that the other clamping parts are also rotated, particularly that they perform a rotational movement about a radial axis with reference to the longitudinal axis of the cleaning spiral.

According to a further embodiment of the invention, at least one spring element is provided, against the reset force of which at least one of the clamping parts, particularly together with the handle part, can be brought into a starting position, automatically or supporting a manual force, in which position the at least one clamping part is brought out of its clamping position against the cleaning spiral and thereby the clamping effect against the cleaning spiral is eliminated.

The starting position can be a position in which the at least one clamping part lies at a distance from the cleaning spiral. Supplementally or alternatively, the starting position can be a position in which the clamping part is merely brought out of its force engagement against the cleaning spiral, which engagement is present in the clamping position in order to produce the drive.

It is useful if the at least one clamping part or the clamping parts are held in the starting position relative to one another by means of the force, particularly the pre-tension force of the spring element. In this way, it is guaranteed that the at least one clamping part is already present in the desired starting position when the pipe cleaning machine is turned on. In total, this results in a high degree of operational reliability, since the at least one clamping part and, if applicable, the handle part are present in a predetermined position, without activation of the handle part.

It is furthermore useful if the drive device, the control device and/or the safety device are disposed on a housing or support, wherein the housing or the support has at least one coupling location for position-fixed coupling against a pipe cleaning machine. In this way, the advancing unit can be mounted on the pipe cleaning machine in a fixed position, in technically simple manner.

The invention furthermore relates to a pipe cleaning machine, particularly a pipe cleaning machine having a drum, with a cleaning spiral that can rotate about its longitudinal axis by means of a motor, and with an advancing unit of the type described above, which can act on the cleaning spiral.

Furthermore, the invention comprises a method for operation of a pipe cleaning machine, such as a pipe cleaning machine having a drum, for example, with a cleaning spiral that can be rotated about its longitudinal axis and with an advancing unit that can act on the cleaning spiral, in particular the advancing unit described above or an advancing unit of the type described above.

It is provided that a drive device that produces drive of the cleaning spiral is activated by means of a handle part, in that the cleaning spiral is clamped between clamping parts, and subsequently a control device is activated by means of the handle part, by means of which device the drive of the cleaning spiral is controlled, for example the drive direction and/or the drive speed of the cleaning spiral is controlled. In this way, the pipe cleaning machine can be easily operated by an operator, using a single hand, for example to produce the drive of the cleaning spiral and subsequently to adjust the drive.

The pipe cleaning machine can be operated or activated with relatively little expenditure of force, by means of the handle part, if the cleaning spiral was already put into a rotational movement and, in particular, the cleaning spiral remains in the rotational movement during the control process.

According to a further development of the invention, it is provided that the at least one clamping part is brought into the clamping position against the cleaning spiral by means of pivoting of the handle part in the direction of a setting axis, particularly the setting axis described above, and a forward drive or reverse drive or, if necessary, a zero drive of the cleaning spiral is produced by means of rotation of the pivoted handle part. In this way, simple operation of the pipe cleaning machine with relatively little expenditure of force is made possible, so that an operator can easily operate the pipe cleaning machine with one hand and has the second hand free to guide the cleaning spiral. A zero drive is understood to mean that the cleaning spiral performs no or only a slight drive movement in this set rotational position of the pivoted handle part.

For safety reasons, it is provided, according to a further development of the invention, that if necessary, activation of a safety device is performed or triggered by means of the handle part, by means of which device at least one of the clamping parts is brought out of a clamping position against the cleaning spiral.

It can be provided that the at least one clamping part is automatically brought out of the clamping position against the cleaning spiral by means of a spring force, by means of releasing the handle part. In this way, the clamping effect of the clamping parts against the cleaning spiral is counteracted in the event that a torsion tension suddenly occurs in the cleaning spiral, without activation of the handle part and thereby without any action on the part of the operator; in particular, the clamping effect is cancelled out.

The drive device, the safety device, and the control device of the method can be the drive device, the safety device, and the control device that were described above in connection with the advancing unit. The same holds true for the individual components of these devices.

Further goals, advantages, characteristics, and use possibilities of the present invention are evident from the following description of an exemplary embodiment, using the drawing. In this regard, all the characteristics described and/or shown in the figures represent the object of the present invention, by themselves or in any desired combination, also independent of how they are combined in the claims or their antecedents.

Figure 2:
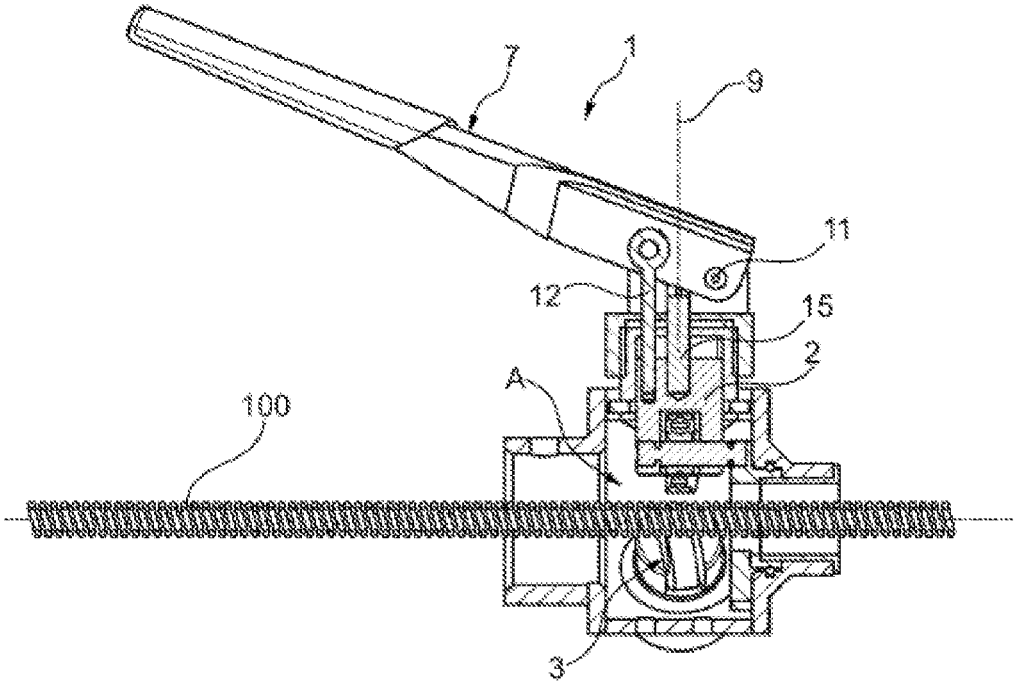
Figure 3:
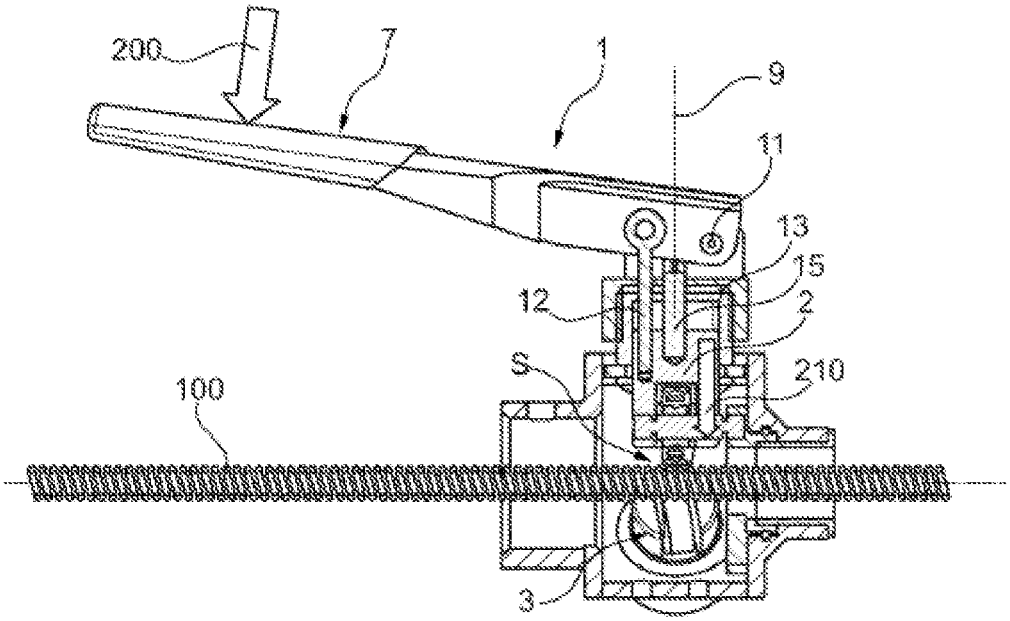
Figure 4A:
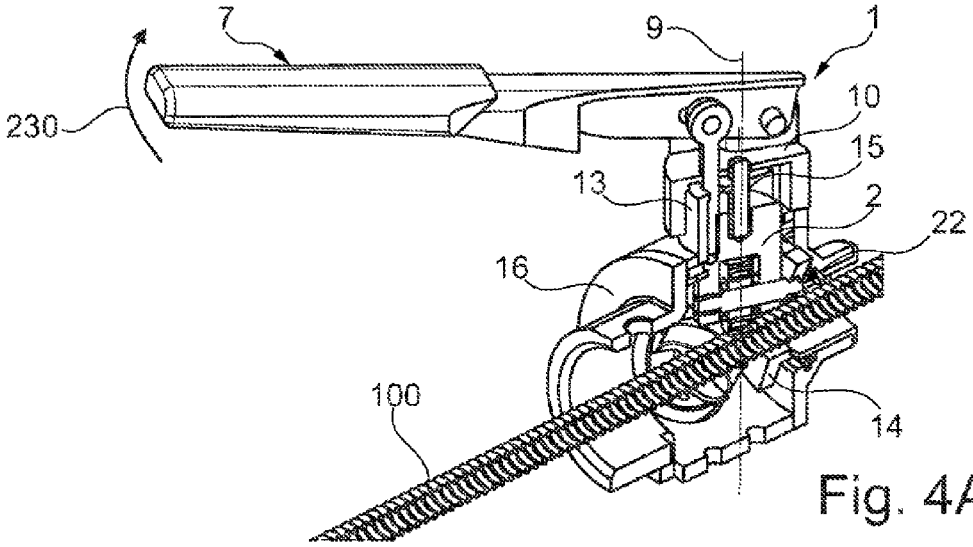
Figure 4B:
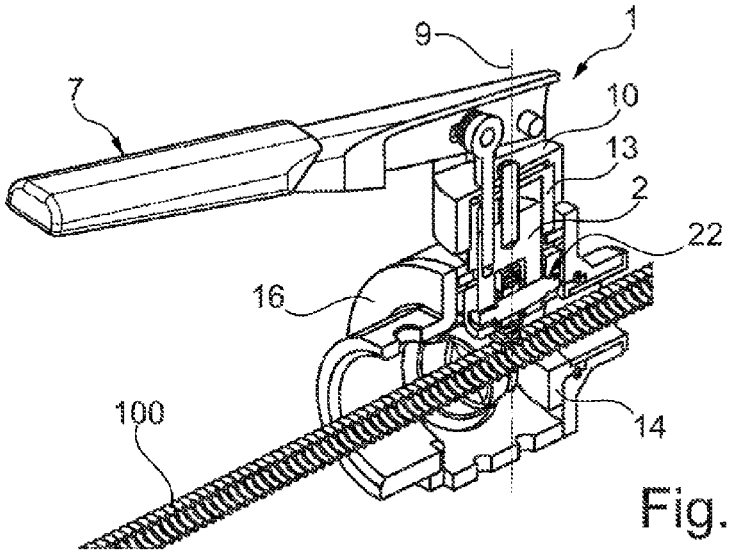
Figure 4C:
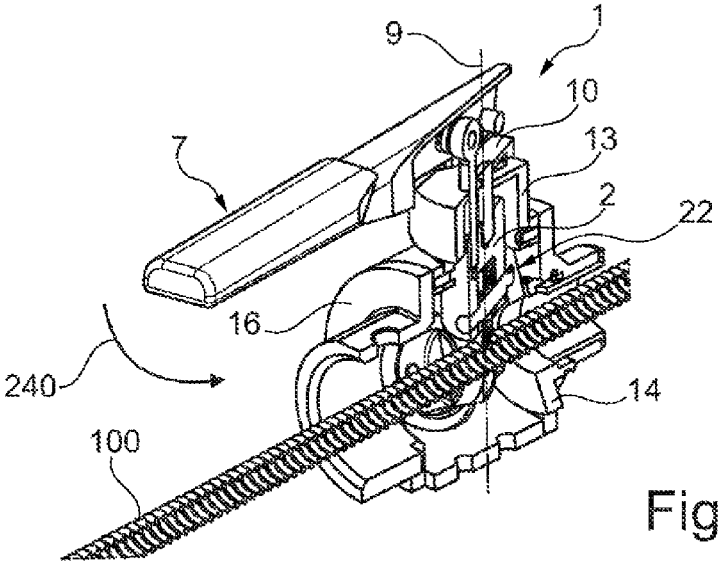

The figures show:

FIG. 1 a possible embodiment of an advancing unit for a cleaning spiral of a pipe cleaning machine, together with a length section of a cleaning spiral, in a sectional representation, FIG. 2 the advancing unit and the cleaning spiral according to FIG. 1 in a sectional representation, wherein a handle part of the advancing unit is in a starting operating position, FIG. 3 the advancing unit and the cleaning spiral according to FIG. 1 in a sectional representation, wherein the handle part has been brought into a position that produces drive, FIGS. 4A, 4B, and 4C as examples, different rotational positions of the handle part when controlling the drive of the cleaning spiral.

FIG. 1 shows a possible embodiment of an advancing unit 1 for a pipe cleaning machine, for example a pipe cleaning machine having a drum, in a sectional representation. The advancing unit 1 serves to put a cleaning spiral 100, which is shown in FIG. 1 in at least a length section, into a drive movement. The cleaning spiral 100 is preferably a spiraled, flexible shaft, which can be rotated about its longitudinal axis 110 by means of a motor (not shown in FIG. 1).

The advancing unit 1 has a drive device having at least two, preferably three clamping parts 2, 3, which device can produce drive of the cleaning spiral 100, of which one clamping part 2 can be brought into a clamping position S against the cleaning spiral 100, in such a manner that the clamping parts 2, 3 press against the cleaning spiral 100, so that when the cleaning spiral 100 is rotating, drive of the cleaning spiral 100 is produced. In FIG. 1, the clamping part 2 is only shown in section, due to the sectional representation. The clamping part 3 can be seen as a contour in the view of FIG. 1. Because of the sectional representation in FIG. 1, the third clamping part cannot be seen.

The clamping part 2, preferably all the clamping parts 2 and 3, have a press-down part 4 on its end facing the cleaning spiral 100, which part is preferably mounted, so as to rotate, by way of an axle 5, on the associated clamping part 2. The press-down part 4 can be a bearing, for example a ball bearing or roller bearing.

The advancing unit 1 furthermore has a control device for controlling the drive of the cleaning spiral 100, wherein the control device utilizes the clamping part 2 or all the clamping parts 2, 3 for this purpose. Furthermore, the advancing unit 1 has a safety device, for example in the manner of a dead-man device, by means of which the clamping part 2 can be brought out of its clamping position S against the cleaning spiral 100, if necessary, and thereby the drive-effecting force fit of the clamping parts 2 and 3 with the cleaning spiral 100 is cancelled out.

It is provided that the control device and the drive device and/or the safety device can be activated by means of a common handle part 6. Single-hand operation is made possible by means of the handle part 6, so that an operator can guide the cleaning spiral 100 with his/her other hand during cleaning.

In order to bring about activation of the drive device, the handle part 6 can pivot in the direction of an axis 8. In order to furthermore bring about activation of the control device, the handle part 6 can be mounted so as to rotate about the axis 8.

In the embodiment according to FIG. 1, the handle part 6 is configured as an activation lever 7. The activation lever 7 is mounted, so as to pivot about a pivot axle 11, in the direction of the axis 8 or in the direction of a setting axis 9 of the clamping part 2, on a control part 10. A transfer element 12 is mounted, so as to rotate, on the activation lever 7, at a distance from the pivot axle 11, which element engages on the clamping part 2 in the direction of the setting axis 9, preferably is linked with it, particularly is linked with it in a fixed position in the axial direction, with reference to the setting axis 9. The transfer element 12 is preferably configured to be stable in shape. For example, the transfer element 12 is an eyebolt, the eye of which is mounted on the activation lever 7 so as to rotate, and the threaded shaft of which is screwed into the clamping part 2.

Preferably, the pivot axle 11 of the activation lever 7 and the mounting location for the transfer element 12 are disposed at a distance from one another, in such a manner that the setting axis 9 runs in between.

The control part 10 is mounted on a guide part 13 that is fixed in place on the housing. The clamping part 2 is guided on the guide part 13, in the case of a movement in the direction of the setting axis 9 and/or in the case of a rotational movement about the setting axis 9.

An additional guide part 15 can be provided, which is connected with the clamping part 2, particularly connected in a fixed position, and is guided relative to a wall, for example an opening 19, particularly a passage opening of the guide part 13 that is fixed in place on the housing. The activation mechanism of the activation lever 7 is additionally stabilized by means of the additional guide part 15. The additional guide part 15 can be configured as a pin element. Preferably, the additional guide part 15 is disposed coaxially with reference to the setting axis 9.

Preferably, the additional guide part 15 is guided on the guide part 13 when the clamping part 2 is displaced in the direction of the setting axis 9, and likewise when the clamping part 2 is rotated about the setting axis 9. The additional guide part 15 can project into an opening 20, particularly a passage opening of the control part 13, with one end. The wall of the opening 20 can fundamentally serve as a guide for the additional guide part 15, or the additional guide part 15 can at least support itself on this wall.

Preferably, the advancing unit 1 has at least one spring element (which cannot be seen in FIG. 1), against the reset force of which element the clamping part 2 is preferably brought out of the clamping position S automatically if the handle part 7 is released. Preferably, a reset of the activation lever 7 also occurs by means of the spring element.

The clamping parts 2, 3 can be configured to be cylindrical, in each instance. Also, the guide part 13 can be configured as a hollow cylinder, and can have a closed end, for example, for example in the manner of a cap, into the interior of which the clamping part 2 is pushed. Preferably, in this regard, the outside diameter of the clamping part 2 essentially corresponds to the inside diameter of the guide part 13, in order to bring about the desired guidance.

The control part 10 can be configured in the manner of a cap, which has a thread on its inside circumference. In order to make rotatability of the activation lever 7 about the setting axis 9 possible, the control part 10 can be screwed onto the guide part 13 and held in the screw connection so as to rotate.

Preferably, the advancing unit 1 has a housing 16, frame or support, which has a passage 21 for the cleaning spiral 100. The housing 16 is linked to a pipe cleaning machine (not shown in FIG. 1), particularly a pipe cleaning machine having a drum, with one end of the passage 21. For this purpose, the housing 16 has a coupling location 18 in the region of the end of the passage 21.

Preferably, the advancing unit 1 can be linked with the pipe cleaning machine in a fixed position. For this purpose, the housing 16 has at least one coupling location 17 on its section that lies on the bottom, for example, in order to hold the advancing unit 1 on the pipe cleaning machine in torque-proof manner with reference to the longitudinal axis 110 of the cleaning spiral 100.

FIG. 2 shows the advancing unit 1 in a starting position A. In the starting position A, the clamping part 2 is not in contact with the press-down part 4 and lies at a distance from the cleaning spiral 100. In the starting position A, the cleaning spiral 100 can support itself on the clamping parts 3 that lie at the bottom.

FIG. 3 shows the advancing unit 1 in the clamping position S, in which the clamping element 2 is pressed against the cleaning spiral 100 and thereby a force fit is formed between the clamping parts 2 and 3 and the cleaning spiral 100, in such a manner that when the cleaning spiral 100 is rotated about its longitudinal axis 110, drive is produced.

In order to bring the clamping part 2 into the clamping position S, the activation lever 7 is pivoted about the pivot axle 11 in the direction according to the arrow 200, wherein a displacement of the clamping part 2 in the direction of the setting axis 9, according to the arrow 210, comes about by means of the transfer element 12.

The additional guide part 15, together with the clamping part 2, is displaced relative to the guide part 13 in the direction of the setting axis 9, according to the arrow 210. The activation state, as shown in FIG. 1, is achieved by means of pivoting the activation lever 7 according to FIG. 3. There, forward drive of the cleaning spiral 100, according to the arrow 220, is shown as an example of drive.

If the spring element is provided, the following safety function can be implemented: As soon as the activation lever 7 is released by the operator, the activation lever 7 and the clamping part 2 are pivoted back into the starting position A according to FIG. 2, preferably automatically, as the result of the force of the spring element, so that the operator can cancel out drive of the cleaning spiral 100 as desired.

FIGS. 4A, 4B, and 4C show the activation lever 7 in different positions, in which a different drive of the cleaning spiral 100 is brought about, in each instance.

In FIG. 4A, the activation lever 7 has been rotated about the setting axis 9 in the direction according to the arrow 230. Because of the rotational movement, the control part 10 and the transfer element 12, together with the clamping part 2, have rotated relative to the guide part 13. As a result, the clamping part 2, with its press-down part 4, has been brought into a rotational position on the cleaning spiral 100 such that as a result, in the clamping position S of the clamping parts 2 and 3 against the cleaning spiral 100, a drive movement in a direction, for example a reverse drive movement, takes place. As a result, withdrawal of the cleaning spiral 100 from the pipeline to be cleaned can take place.

In FIG. 4B, the activation lever 7 is in a starting rotational position, which is a neutral position. In this rotational position, no drive or only slight drive is brought about, even though the clamping parts 2 and 3 are clamped against the cleaning spiral 100.

In FIG. 4C, the activation lever 7 is rotated about the setting axis 9 in the reverse direction of rotation as compared with the representation of FIG. 4A. The clamping part 2 is situated in a rotational position such that drive in the opposite direction as compared with the representation in FIG. 4A is achieved, for example a forward drive movement.

The rotational movement of the clamping part 2 about the setting axis 9 can also be performed by the at least one other clamping part 3. For this purpose, a driver 14, particularly a driver disk, can be provided, which is movement-coupled with the clamping parts 2, 3 in corresponding manner. For example, the driver 14 is held on the housing 16 so as to rotate about the longitudinal axis 110. For example, the axle 5 of the respective clamping part 2, 3 engages into an associated recess or groove of the driver, and forms a coupling 22, so that the driver 14 is brought into a rotational movement about the axis 110 by means of a rotational movement of the clamping part 2, and, because of the coupling with the at least one other clamping part 2, this part is also rotated.

REFERENCE SYMBOL LIST

1 advancing unit
2 clamping part
3 clamping part
4 press-down element
5 axle
6 handle part
7 activation lever
8 axis
9 setting axis
10 control part
11 pivot axle
12 transfer element
13 guide part
14 driver
15 additional guide part
16 housing
17 coupling location
18 coupling location
19 opening
20 opening
21 passage
22 coupling
100 cleaning spiral
110 longitudinal axis
200 arrow
210 arrow
220 arrow
230 arrow
240 arrow
A starting position
S clamping position

The invention claimed is:

1. An advancing unit for a cleaning spiral of a pipe cleaning machine, which spiral can rotate about its longitudinal axis driven by a motor, the unit comprising:

a housing;

a drive device that can produce an advancing movement of the cleaning spiral, the drive device having at least two clamping parts which can be brought into a clamping position against the cleaning spiral, in such a manner that the clamping parts press against the cleaning spiral, so that when the cleaning spiral rotates, an advancing movement of the cleaning spiral is produced;

a control device for controlling the advancing movement of the cleaning spiral by moving a first of the at least two clamping parts;

a safety device, by which the first or a second of the at least two clamping parts can be brought out of its clamping position against the cleaning spiral;

a handle part, wherein the control device and the drive device and/or the safety device can be activated by said handle part, wherein the handle part is rotatable and pivotally mounted to the housing so as to rotate about a first axis in a rotating motion and to pivot about a second axis in a pivoting motion, the second axis being different from the first axis, wherein one of the rotating motion or the pivoting motion is utilized for at least one of activation of the drive device or triggering of the safety device, and a different one of the rotating motion or the pivoting motion is utilized for activation of the control device.

2. The advancing unit according to claim 1, wherein the handle part can be pivoted about a pivot axle which is arranged in the second axis at a distance from the first axis.

3. The advancing unit according to claim 1, wherein the drive device and the safety device both act on the first clamping part.

4. The advancing unit according to claim 1, wherein the drive device and/or the safety device, together with the control device, can act on the first clamping part.

5. The advancing unit according to claim 1, wherein the handle part is configured as an activation lever which is mounted so as to pivot about a pivot axle arranged in the second axis on a control part, wherein the first clamping part is movable along a setting axis, wherein the control part is mounted, so as to rotate about the first axis on a guide part fixed in place on the housing, which guide part guides the first clamping part, and wherein a transfer element is provided, which engages on the activation lever at a distance from the pivot axle, and acts on the first clamping part in the direction of the setting axis.

6. The advancing unit according to claim 5, wherein the transfer element engages on the activation lever at a distance from the pivot axle, and wherein the setting axis runs in between the transfer element and the pivot axle.

7. The advancing unit according to claim 5, wherein the activation lever, the control part, the transfer element, and the first clamping part are connected in torque-proof manner with reference to the setting axis, and can be rotated about the setting axis relative to the guide part.

8. The advancing unit according to claim 5, wherein an additional guide part is provided, which part is firmly connected with the first clamping part and is guided on a wall of an opening of the guide part that is fixed in place on the housing and/or on a wall of an opening of the control part.

9. The advancing unit according to claim 1, wherein at least one spring element is provided, against the reset force of which the first clamping part, together with the handle part, can be brought into a starting position (A), automatically or supporting a manual force, in which position the first clamping part is brought out of its clamping position (S) against the cleaning spiral.

10. The advancing unit according to claim 1, wherein the housing has at least one coupling location for position-fixed coupling against a pipe cleaning machine.

11. The advancing unit for a pipe cleaning machine as in claim 1, wherein the pipe cleaning machine has a drum.

12. The advancing unit according to claim 1, wherein the advancing unit is configured to activate the drive device by means of the handle part, wherein said activation is executed in such a way that the cleaning spiral is clamped between the at least two clamping parts, and subsequently the control device is activated by means of the handle part in order to control the drive of the cleaning spiral.

13. The advancing unit according to claim 12, wherein the first clamping part is brought into the clamping position against the cleaning spiral by means of pivoting of the handle part in the direction of a setting axis, and a forward drive or reverse drive or a zero drive of the cleaning spiral is produced by means of rotation of the pivoted handle part.

14. The advancing unit according to claim 12, wherein if necessary, the handle part is configured to activate said safety device, by means of which safety device the first clamping part or the second clamping part is brought out of a clamping position against the cleaning spiral.

15. The advancing unit according to claim 14, wherein the first clamping part is automatically brought out of the clamping position against the cleaning spiral by means of a spring force, by means of releasing the handle part.

* * * * *